US005726133A

United States Patent [19]

Blahey et al.

[11] Patent Number: 5,726,133

[45] Date of Patent: Mar. 10, 1998

[54] LOW ASH NATURAL GAS ENGINE OIL AND ADDITIVE SYSTEM

[75] Inventors: Alan G. Blahey; James W. Finch, both of Sarnia, Canada

[73] Assignee: Exxon Research and Engineering Company, Florham Park, N.J.

[21] Appl. No.: 607,502

[22] Filed: Feb. 27, 1996

[51] Int. Cl.[6] ..... C10M 135/18; C10M 129/54; C10M 129/76

[52] U.S. Cl. ..... 508/390; 508/391; 508/398; 508/399; 508/413; 508/417; 508/518

[58] Field of Search ..... 508/390, 391, 508/398, 399, 413, 417, 578

[56] References Cited

U.S. PATENT DOCUMENTS

| | | | |
|---|---|---|---|
| 3,775,321 | 11/1973 | Turnquest et al. | 252/42.7 |
| 3,873,455 | 3/1975 | Schieman | 252/32.7 E |
| 3,909,420 | 9/1975 | Turnquest et al. | 252/47 |
| 4,171,269 | 10/1979 | Sung et al. | 252/33 |
| 4,181,619 | 1/1980 | Schmitt et al. | 252/32.5 |
| 4,375,418 | 3/1983 | Zoleski et al. | 252/33.4 |
| 4,764,296 | 8/1988 | Kennedy | 252/334 |
| 4,925,579 | 5/1990 | Stemke | 252/32.7 E |
| 4,954,273 | 9/1990 | Denis et al. | 252/39 |
| 5,137,648 | 8/1992 | Marsh et al. | 508/391 |
| 5,202,036 | 4/1993 | Ripple et al. | 252/33.4 |
| 5,262,073 | 11/1993 | Schmitt et al. | 252/33.2 |
| 5,318,710 | 6/1994 | Campbell | 252/25 |
| 5,320,762 | 6/1994 | Campbell | 252/25 |
| 5,320,763 | 6/1994 | Campbell | 252/25 |
| 5,328,620 | 7/1994 | Ripple | 508/390 |
| 5,330,664 | 7/1994 | Wollenberg et al. | 508/390 |

FOREIGN PATENT DOCUMENTS

| | | | |
|---|---|---|---|
| 1136606 | 11/1982 | Canada | C10M 1/48 |
| 1177472 | 11/1984 | Canada | C10M 1/48 |
| 1189058 | 6/1985 | Canada | C10M 169/00 |
| 298262A5 | 2/1992 | Germany | C10M 159/22 |
| 299535A5 | 4/1992 | Germany | C10M 159/22 |
| 104845A | 4/1993 | Romania | C10M 105/68 |
| WO9303121 | 2/1993 | WIPO | C10M 141/10 |
| WO94/28095 | 8/1994 | WIPO | C10M 135/18 |

*Primary Examiner*—Jacqueline V. Howard
*Attorney, Agent, or Firm*—Joseph J. Allocca

[57] ABSTRACT

The present invention is directed to a low ash natural gas engine oil which contains an additive package including a particular combination of detergents and also containing other standard additives such as dispersants, antioxidants, antiwear agents, metal deactivators, antifoamants and pour point depressants and viscosity index improvers. The low ash natural gas engine oil exhibits reduced deposit formation and enhanced resistance to oil oxidation and nitration.

7 Claims, No Drawings

LOW ASH NATURAL GAS ENGINE OIL AND ADDITIVE SYSTEM

FIELD OF THE INVENTION

The present invention relates to a low ash gas engine oil additive formulation and to gas engine oils containing such additive formulation, the formulation including a particular combination of detergents and also containing other standard additives to produce a package which enhances the resistance of the formulated oil to oxidation, nitration and deposit formation.

BACKGROUND OF THE INVENTION

A large percentage of gas fired engines are of 4-cycle designs, similar to those for heavy duty diesel engines. The natural gas fired engines are large, having up to 16 cylinders, and often generating between 500–2000 HP. The engines are typically used in the Oil and Gas industry to compress natural gas at well heads and along pipelines. Due to the nature of this application, the engines often run continuously near full load conditions, shutting down only for maintenance such as for oil changes. This condition of running continuously near full load places severe demands on the lubricant. Indeed, since the lubricant is subjected to sustained high temperature environment, the life of the lubricant is often limited by oil oxidation processes. Additionally, since natural gas fired engines run with high emissions of oxides of nitrogen (NOx), the lubricant life may also be limited by oil nitration processes. A longer term requirement is that the lubricant must also maintain cleanliness within the high temperature environment of the engine, especially for critical components such as the piston, and piston rings. Therefore, it is desirable for gas engine oils to have good cleanliness properties, while promoting long life through enhanced resistance to oil oxidation and nitration.

The combustion of diesel fuel often results in a small amount of incomplete combustion (e.g., exhaust particulates). The incombustibles provide a small but critical degree of lubrication to the exhaust valve/seat interface, thereby ensuring the durability of both cylinder heads and valves. The combustion of natural gas, on the other hand, is often very complete, with virtually no incombustible materials. Therefore, the durability of the cylinder head and valve is controlled by the properties of the lubricant and its consumption rate. For this reason, Natural Gas Engine Oils (NGEO) are classified according to their ash content, since it is the lubricant ash which acts as a solid lubricant to protect the valve/seat interface. The oil industry has accepted guidelines which define a Low Ash NGEO to have a sulfated ash level in the 0.15 to 0.6% range. For correct engine operation, gas engine manufacturers define lubricant ash requirements as part of the lubricant specifications. For example, a manufacturer may require the gas engine oil to have between 0.4–0.6% ash. Running the engine with too low an ash level will likely result in shortened life for the valves or cylinder head. Running the engine with too high an ash level will likely cause excessive deposits in the combustion chamber and upper piston area. Based on experience, gas engine manufacturers may even identify a specific lubricant ash level within the ash specification range, such as stating a preference for 0.45% ash. In order to control the lubricant ash level, the lubricant detergent type and treat rate must be carefully selected.

SUMMARY OF THE INVENTION

The present invention relates to a gas engine lubricating oil which provides for a low ash content.

The natural gas engine lubricant comprises:

a) a major amount of a lubricating oil base stock having a kinematic viscosity at 100° C. of about 5 to 16 cSt, more preferably about 9 to 14 cSt, most preferably about 11 to 13 cSt; and b) a minor amount of an additive mixture comprising a mixture of detergents comprising at least one low Total Base Number (TBN) alkali or alkaline earth metal salt, or mixture thereof, preferably alkaline earth metal salt and at least one other detergent which is more neutral than the aforesaid low TBN alkali or alkaline earth metal salt.

Other standard additives typically used in gas engine oils may also be present and they include:

- a dispersant to enhance engine cleanliness, and to minimize the dropout of oil insoluble compounds;
- a supplementary antioxidant to extend oil life;
- an antiwear additive to enhance engine durability;
- a metal deactivator to reduce the catalytic degradation of the lubricant from fresh metal surfaces;
- an antifoam additive to control the foaming tendency of the oil;
- a pour point depressant to enhance the lubricant low temperature properties;
- a viscosity index improver to impart multigrade viscosity characteristics.

DETAILED DESCRIPTION OF THE INVENTION

The low ash gas engine lubricating oil formulation of the present invention comprises a major amount of a lubricating oil base stock and an additive comprising a mixture of at least:

a) a low TBN alkali or alkaline earth metal salt or mixture thereof, wherein, by low TBN, it is meant that the alkali or alkaline earth metal salt has a TBN of about 250 and less, more preferably about 200 and less, most preferably about 150 and less. The Total Base Number (TBN) is expressed in units of mg KOH/mg as per test method ASTM D-2896. and b) a second alkali or alkaline earth metal salt or mixture thereof having a TBN lower than the aforesaid component. Typically, this metal salt will have a TBN about half or less of the aforesaid component. Therefore it will be a metal salt with a TBN of about 125 or less, or more preferably about 100 or less, most preferably about 75 or less.

The metal salts may be based preferably on sodium, magnesium or calcium, and may exist as phenates, sulfonates, or salicylates. More preferably, the metal salts will be calcium phenates, calcium sulphonates calcium salicylates and mixtures thereof, most preferably calcium phenates, calcium sulfonates and mixtures thereof.

The metal salts are used in concentrations which contribute a sulfated ash of about 0.1 to 0.6% ash (ASTM D-874) to the fully formulated gas engine oil. Expressed otherwise in terms based on the total formulated oil:

- the metal salts are employed in a total amount in the range of about 0.3 to 1.6 vol %, preferably 0.5 to 1.5 vol %, and most preferably 0.8 to 1.4 vol %, active ingredient (AI).
- The low TBN alkali or alkaline earth metal salt or mixtures thereof is (are) generally used in an amount in the range of about 0.2 to 1.1 vol %, more preferably 0.4 to 1.0 vol %, and most preferably 0.55 to 0.9 vol % active ingredient (AI), while the second, more neutral alkali or alkaline earth metal salt or mixture thereof is (are) generally used in an amount in the range of about 0.1 to 0.7 vol %, more preferably 0.2 to 0.6 vol %, and most preferably 0.3 to 0.55 vol % active ingredient (AI).

The mixture of detergents is used in a (low TBN metal salt) to (second, more neutral metal salt) volume ratio of about 1.2:1 to 2.3:1, more preferably 1.4:1 to 2.1:1, and most preferably in the ratio of 1.6:1 to 1.9:1.

The lubricating oil base stock is any natural or synthetic lubricating base oil stock fraction having a kinematic viscosity at 100° C. of about 5 to 16 cSt, more preferably about 9 to 14 cSt, most preferably about 11 to 13 est.

The lubricating oil basestock can be derived from natural lubricating oils, synthetic lubricating oils, or mixtures thereof. Suitable lubricating oil basestocks include basestocks obtained by isomerization of synthetic wax and slack wax, as well as hydrocraekate basestocks produced by hydrocracking (rather than solvent extracting) the aromatic and polar components of the crude.

Natural lubricating oils include animal oils, vegetable oils (e.g., rapeseed oils, castor oils and lard oil), petroleum oils, mineral oils, and oils derived from coal or shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

The resulting isomerate product is typically subjected to solvent dewaxing and fractionation to recover various fractions of specific viscosity range. Wax isomerate is also characterized by possessing very high viscosity indices, generally having a VI of at least 130, preferably at least 135 and higher and, following dewaxing, a pour point of about −20° C. and lower.

The production of wax isomerate oil meeting the requirements of the present invention is disclosed and claimed in U.S. Pat. Nos. 5,059,299 and 5,158,671.

The fully formulated gas engine oil may contain additional, typical additives known to those skilled in the industry, used on an as-received basis.

Thus, the fully formulated oil may contain dispersants of the type generally represented by succmimides (e.g., polyisobutylene succinic acid/anhydride (PIBSA)-polyamine having a PIBSA molecular weight of about 700 to 2500). The dispersants may be borated or non-borated. The dispersant can be present in the amount of about 0.5 to 8 vol %, more preferably in the amount of about 1 to 6 vol %, most preferably in the amount of about 2 to 4 vol %.

Antioxidants may be of the phenol (e.g., o,o'ditertiary alkyl phenol such as ditertbutyl phenol), or amine (e.g., dialkyl diphenyl amine such as dibutyl, octyl buty, or dioctyl diphenyl amine) type, or mixtures thereof. More preferably, the antioxidants will be hindered phenols, or aryl amines which may or may not be sulfurized. Antioxidants can be present in the amount of about 0.05 to 1.5 vol %, more preferably in the amount of about 0.1 to 0.8 vol %, most preferably in the amount of about 0.2 to 0.6 vol %.

Metal deactivators may be of the aryl thiazines, triazoles, or alkyl substituted dimercapto thiadiazoles (DMTD's), or mixtures thereof. Metal deactivators can be present in the amount of about 0.01 to 0.2 vol %, more preferably in the amount of about 0.02 to 0.15 vol %, most preferably in the amount of about 0.05 to 0.1 vol %.

Antiwear additives such as metal dithiophosphates (e.g., zinc dialkyl dithiophosphate, ZDDP), metal dithiocarbamates, metal xanthates or tricrecylphosphates may be included. Antiwear additives can be present in the amount of about 0.05 to 1.5 vol %, more preferably in the amount of about 0.1 to 1.0 vol %, most preferably in the amount of about 0.2 to 0.5 vol %.

Pour point depressants such as poly(meth)acrylates, or alkyl-aromatic polymers may be included. Pour point depressants can be present in the amount of about 0.05 to 0.6 vol %, more preferably in the amount of about 0.1 to 0.4 vol %, most preferably in the amount of about 0.2 to 0.3 vol %.

Antifoamants such as silicone antifoaming agents can be present in the amount of about 0.001 to 0.2 vol %, more preferably in the amount of about 0.005 to 0.15 vol %, most preferably in the amount of about 0.01 to 0.1 vol %.

Viscosity Index Improvers (VII's) may be any polymer which imparts multifunctional viscosity properties to the finished oil, including materials such as olefin copolymers, polymethacrylates, styrene diene block copolymers, and star copolymers. The VII's may also be multifunctional from the perspective of offering secondary lubricant performance features such as additional dispersancy. VII's can be present in the amount of up to 15 vol %, more preferably in the amount of up to 13 vol %, most preferably in the amount of up to 10 vol %.

Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, page 1–11, the disclosures of which are incorporated herein by reference.

The present invention is further described in the following non-limiting examples.

EXPERIMENTAL

In all of the following examples all formulated oils had ash contents of 0.45%.

EXAMPLES

Table 1 below details a series of experimental formulations which demonstrates the invention. In Table 1 below, Formulation 1 (Commercial Oil I) is a commercial oil using solvent extracted base oils, and an additive package identified as Oloa 1255. Oloa 1255 is a low ash gas engine oil additive package supplied by Oronite. Oloa 1255 is one of the most widely sold gas engine oil additive package in the world, and represents a "benchmark standard" against which other oils may be measured.

Formulation 2 uses only one detergent, a 135 TBN calcium phenate detergent. Formulation 5 uses only one detergent, a 300 TBN calcium sulphonate detergent. Formulations 6 and 7 are based on combinations of detergents using a 300 TBN calcium sulphonate. Formulations 3 and 4, examples of the invention, use a combination of a 135 TBN calcium phenate detergent with either a neutral calcium sulphonate or a low TBN calcium salicylate.

TABLE 1

| | | Formulation | | | | | | |
|---|---|---|---|---|---|---|---|---|
| | | 1 | 2 (c) | 3 (c) | 4 (c) | 5 (c) | 6 (c) | 7 (c) |
| | Description (Vol %) | | | | | | | |
| | 600 SN Base Oil | — | 88.43 | 90.34 | 89.84 | 87.00 | 87.00 | 87.00 |
| | 1200 SN Base Oil | — | 4.00 | 1.75 | 2.25 | 6.91 | 6.56 | 6.56 |
| | Dispersant | — | 4.00 | 4.00 | 4.00 | 4.00 | 4.00 | 4.00 |
| | Antioxidant | — | 0.50 | 0.50 | 0.50 | 0.50 | 0.50 | 0.50 |
| | Metal Deactivator | — | 0.05 | 0.05 | 0.05 | 0.05 | 0.05 | 0.05 |
| | ZDDP | — | 0.32 | 0.32 | 0.32 | 0.32 | 0.32 | 0.32 |
| | Antifoam | — | 0.05 | 0.05 | 0.05 | 0.05 | 0.05 | 0.05 |
| | Pour Point Depressant | — | 0.40 | 0.40 | 0.40 | 0.40 | 0.40 | 0.40 |
| | Neutral Calcium Sulphonate (45% AI) | — | — | 0.81 | — | — | 0.35 | — |
| | 70 TBN Calcium Salicylate (50% AI) | — | — | — | 0.81 | — | — | 0.35 |
| | 135 TBN Calcium Phenate (37% AI) | — | 2.25(b) | 1.78 | 1.78 | — | — | — |
| | 300 TBN Calcium Sulphonate (100% AI) | — | — | — | — | 0.77(a) | 0.77 | 0.77 |
| | Commercial Oil I | 100 | — | — | — | — | — | — |
| | Viscosity Target kV @ 100° C. | — | 13.5 | 13.5 | 13.5 | 13.5 | 13.5 | 13.5 |
| | Viscosity Measured kV @ 100° C. | 13.5 | 13.43 | 13.53 | 13.55 | 13.45 | 13.51 | 13.49 |
| Oxidation Screener Test | Hours to 200% visc. increase | 110 | 168 | 144 | 174 | 127 | 95 | 120 |
| | Hours to 300% visc. increase | 114 | 174 | 150 | 182 | 135 | 104 | 128 |
| | Hours to 375% visc. increase | 116 | 179 | 152 | 184 | 139 | 106 | 132 |
| Deposit Screener Test | Deposit Weight @ 315° C. (mg) | 27 | 28.1 | 5.6 | 17.0 | 76.5 | 53.0 | 61.0 |
| NGEO Degradation Test | Oxidation (relative) | 1.00 | 0.75 | 0.78 | 0.81 | 0.71 | 0.70 | 0.72 |
| | Nitration (relative) | 1.00 | 0.97 | 0.85 | 1.03 | 1.04 | 1.01 | 1.06 |
| | Viscosity Increase (relative) | 1.00 | 0.77 | 0.74 | 0.81 | 0.88 | 0.86 | 0.90 |

(a) treat rate of 300 TBN Calcium Sulphonate required to give 0.45% sulphated ash (ASTM D-874)
(b) treat rate of 135 TBN Calcium Phenate required to give 0.45% sulphated ash (ASTM D-874)
(c) formulations 2–7 use dispersant, anti oxidant and ZDDP at above treat rates in order to correlate results with Commercial Oil I The Oxidation Screener Test is a lab glassware oxidation test. It monitors the time required for the oil to oxidize and reach a specific level of viscosity increase (200, 300, 375% above fresh viscosity). Longer times equate to better oxidation resistance. The commercial oil (Commercial Oil I) achieved only 116 hours to 375% viscosity increase. The low TBN calcium phenate based formulations outperformed the 300 TBN calcium sulphonate based formulations, and Commercial Oil I.

The NGEO Degradation Test is a glassware lab test which assesses several facets of the degradation of natural gas engine oils. All results are expressed as a fraction of the results for Commercial Oil I. Therefore, all results for Commercial Oil I will have a result of 1.00, and any results lower than 1.00 demonstrate superior performance to that for Commercial Oil I.

The data show relative measurements of oil oxidation as measured by differential infrared analysis of the used oil. All experimental formulations have superior resistance to oxidation versus the performance for Commercial Oil I. The formulations based on 300 TBN calcium sulphonate have marginally better performance over those formulations with 135 TBN calcium phenate based formulations.

The data show relative measurements of oil nitration as measured by differential infrared analysis of the used oil. The results show the formulations based on 300 TBN calcium sulphonate based formulations to be equivalent/slightly worse than for Commercial Oil I. The formulations based on 135 TBN calcium phenate showed nitration resistance that was equivalent/better than that for Commercial Oil I.

The data show relative measurements of viscosity increase. While all experimental formulations demonstrated less viscosity increase than that for Commercial Oil I, the formulations based on 135 TBN calcium phenate demonstrated superior performance.

The Deposit Screener Test is a lab screener test which assesses the deposit forming tendency of lubricants. It measures the weight of lubricant deposit which forms on a heated metal coupon, therefore lower results mean less deposits. The above data show that the formulation based on 300 TBN calcium sulphonate all generated higher deposits than the commercial oil. Using 135 TBN calcium phenate as the sole detergent, the lubricant deposit tendency (28 mg deposit) was found to be only equivalent to that for Commercial Oil I (27 mg deposit). When 135 TBN calcium phenate was used with neutral calcium sulphonate, or 70 TBN calcium salicylate, the deposit forming tendency was improved over that for Commercial Oil I.

While the screener test results demonstrated clear advantages for this invention in terms of oil oxidation, nitration and viscosity control, it was uncertain whether the deposit control with the experimental oils truly exceeded that for Commercial Oil I (Formulation 1). Hence, an engine test was run, with the results demonstrated in Table 2.

TABLE 2

Summary of Engine Deposit Test Data
(Caterpillar 3304 Natural Gas Engine, 250 hour test at full load)

| Test Description | 1 | 2 |
|---|---|---|
| Formulation | 1 | 8 (1) |
| Piston Deposits (Demerits as per CRC piston rating procedures higher demerits indicate more deposits) | | |
| Land 1 | 14.15 | 8.91 |
| Land 2 | 4.31 | 1.86 |
| Groove 1 | 10.89 | 3.13 |
| Grove 2 | 1.91 | 0 |
| Total Unweighted Demerits | 31.27 | 13.91 |
| Lubricant Viscosity Increase | | |
| (cSt @ 100° C.) | 1.63 | 1.35 |
| (% @ 100° C.) | 12.10 | 10.01 |
| Wear Metals (ppm) | | |
| Iron | 5 | 7 |
| Lead | 2 | 7 |

TABLE 2-continued

Summary of Engine Deposit Test Data
(Caterpillar 3304 Natural Gas Engine, 250 hour test at full load)

| | | |
|---|---|---|
| Copper | 2 | 0 |
| Oil Consumption (g/BHP-hour) | 1.09 | 1.11 |

(1) Formulation 8 is similar to Formulation 3 but uses 0.81 vol % of a different neutral calcium sulfonate and uses 1.78 vol % of a 180 TBN calcium phenate rather than 1.28 vol % of the 135 TBN calcium phenate of Formulation 3.

The engine test results of Table 2 demonstrate that this invention offers enhanced cleanliness. This is shown by reduced piston deposits on both the piston lands, and ring grooves in the upper piston area. Test results also demonstrate the invention to offer a slight reduction in viscosity increase, and maintain wear control as measured by the wear metals in the used oil.

In order to determine the effectiveness of the invention in hydrocracked basestocks, additional work was completed, as summarized in Table 3 below. Formulation 10 is an example of the invention in solvent extracted basestocks.

Formulation 11 is an example of the invention in a hydrocracked or severely hydrotreated basestock. For reference, test results were also generated on Commercial Oil I (Formulation 1) which is formulated with solvent extracted basestocks, and Oloa 1255, a Commercial additive package. Also test results are presented for Commercial Oil II, (Formulation 9) a lubricant which is formulated with a hydrocracked or severely hydrotreated basestock and Oloa 1255.

It is tempting to draw precise comparisons between test results from Table 1, and from Table 3. Drawing such comparison would find that the test results are not identical for similar formulations (e.g., Formulation 10 vs. Formulation 3). This is explained by noting that:

Some difference is attributable to test repeatability and variations in the test procedures.

Formulations in Table 1 were blended using one set of additive samples, while formulations in Table 3 were blended a year later with another set of additive samples. Hence differences in test results may be attributable to variation in additive quality/performance as a result of normal additive production variation.

Therefore, it is suggested that more precise comparison should be made between data from within Table 1 alone, or within Table 3 alone. An important observation, however, is that any general conclusions drawn from the data in Table 1 are fully supported by the conclusions drawn from the data of Table 3.

TABLE 3

Test Formulations and Screener Test Results

| | Formulation | | | |
|---|---|---|---|---|
| Description (vol %) | 1 Commercial Oil I | 9 Commercial Oil II | 10 SN Base + Invention | 11 Hydrocracked Base + Invention |
| 600 SN Base | — | — | 90.00 | — |
| 1200 SN Base | — | — | 2.09 | 0.59 |
| Hydrocracked | — | — | — | 91.50 |
| Commercial Oil I | 100.00 | — | — | — |
| Commercial Oil II | — | 100.00 | — | — |
| 135 TBN calcium phenate (37% AI) | — | — | 1.78 | 1.78 |

TABLE 3-continued

| | | | | |
|---|---|---|---|---|
| Neutral calcium sulphonate (45% AI) | — | — | 0.81 | 0.81 |
| Dispersant | — | — | 4.00 | 4.00 |
| Antioxidant | — | — | 0.50 | 0.50 |
| Metal Deactivator | — | — | 0.05 | 0.05 |
| ZDPP | — | — | 0.32 | 0.32 |
| Anti foamant | — | — | 0.05 | 0.05 |
| Pour Point Depressant | — | — | 0.40 | 0.40 |

| | | Formulation | | | |
|---|---|---|---|---|---|
| Component | Description | 1 Commercial Oil I | 9 Commercial Oil II | 10 SN Base + Invention | 11 Hydrocracked Base + Invention |
| Viscosity | Target kV @ 100° C. | — | — | 13.50 | 13.50 |
| | Measured kV @ 100° C. | 13.7 | 13.7 | 13.51 | 12.72 |
| Seq III-E | Hours to 200% visc. increase | 111 | 180 | 133 | 175 |
| | Hours to 300% visc. increase | 119 | 185 | 138 | 188 |
| | Hours to 375% visc. increase | 122 | 188 | 140 | 195 |
| NGEO | Oxidation (relative) | 1.00 | 0.84 | 0.78 | 0.51 |
| Degradation | Nitration (relative) | 1.00 | 0.90 | 0.97 | 0.81 |
| Test | Viscosity Increase (relative) | 1.00 | 0.82 | 0.85 | 0.76 |

The Oxidation Screener Test results demonstrate that the invention has superior resistance to oxidation (longer times to 375% viscosity increase) when used in either solvent extracted, or hydrocracked basestocks.

The NGEO Degradation Test results verify that the invention has superior resistance to oxidation and nitration (smaller numerical values of Relative Oxidation and Nitration) when used in either solvent extracted or hydrocracked basestocks. The NGEO Degradation Test results verify that the invention has superior resistance to viscosity increase (smaller numerical values of Relative Viscosity Increase) when used in either solvent extracted or hydrocracked basestocks.

The screener test data of Table 1 demonstrate that the invention offers superior control of deposit formation, and reduced oil degradation (measured by oxidation, nitration, and viscosity increase). The invention is formulated with unique combinations of detergents, while being constrained to meet a specific ash requirement. The invention is based on a unique combination of detergents (low TBN alkali or alkaline earth metal salts, or mixtures thereof, preferably calcium phenate, calcium sulfonate or calcium salicylate plus either a neutral or a low TBN alkali or alkaline earth metal salt, or mixture thereof preferably calcium phenate, calcium sulfonate or calcium salicylate), and is complemented by a full additive system. This combination of detergents performs better than one detergent alone (e.g., calcium phenate, or calcium sulphonate alone), and performs better than other mixtures based on calcium sulphonate of high TBN.

The engine data demonstrate that the invention offers superior control of deposits by generating reduced piston deposits. The invention also showed less viscosity increase, demonstrating its ability to resist lubricant degradation. Wear control was maintained, as determined by equivalent metals content in the used oil.

The screener test data of Table 3 confirm the general conclusions from that of Table 1. The data also demonstrate the benefits of the invention using solvent refined and hydrocracked basestocks.

What is claimed is:

1. A method for enhancing the resistance of a natural gas engine oil to oxidation, nitration, deposits formation comprising adding to a natural gas engine oil base stock having a kinematic viscosity at 100° C. of about 5 to 16 cSt a minor amount sufficient to contribute a sulfated ash content of about 0.1 to 0.6% ash by ASTM D-874 of an additive mixture comprising a mixture of detergents comprising at least one first alkali or alkaline earth metal salt or mixture thereof of low Total Base Number (TBN) of about 250 and less and at least one second alkali or alkaline earth metal salt or mixture thereof which is more neutral than the first low TBN salt.

2. The method of claim 1 wherein the second more neutral salt or mixture thereof has a TBN about one-half or less that of the first salt.

3. The method of claim 1 wherein the metal salts are employed in a total amount in the range 0.3 to 1.6 vol % active ingredient based on the lubricating oil formulation.

4. The method of claim 3 wherein the first low TBN metal salt or mixture thereof is employed in an amount in the range 0.2 to 1.1 vol % active ingredient and the second more neutral metal salt is employed in an amount in the range of about 0.1 to 0.7 vol % active ingredient.

5. The method of claim 1, 2, 3 or 4 wherein the metal salts are sodium, magnesium or calcium as phenates, sulfonates or salicylates.

6. The method of claim 1, 2, 3 or 4 wherein the metal salts are used in a (low TBN alkali or alkaline earth metal salt) to (second more neutral metal salt) volume ratio of about 1.2:1 to 2.3:1.

7. The method of claim 5 wherein the metal salts are used in a (low TBN alkali or alkalene earth metal salt) to (second more neutral metal salt) volume ratio of about 1.2:1 to 2.3:1.

* * * * *